US006568484B1

(12) United States Patent
Schmid et al.

(10) Patent No.: US 6,568,484 B1
(45) Date of Patent: May 27, 2003

(54) PNEUMATIC PISTON PERCUSSIVE MECHANISM WITH A HOLLOW PERCUSSION PISTON

(75) Inventors: Wolfgang Schmid, Müchen (DE); Mirko Lysek, München (DE); Rudolf Berger, Grünwald (DE)

(73) Assignee: Wacker Construction Equipment AG, Munich (DE)

( * ) Notice: Subject to any disclaimer, the term of this patent is extended or adjusted under 35 U.S.C. 154(b) by 0 days.

(21) Appl. No.: 10/018,590

(22) PCT Filed: Jun. 21, 2000

(86) PCT No.: PCT/EP00/05752

§ 371 (c)(1),
(2), (4) Date: Dec. 12, 2001

(87) PCT Pub. No.: WO01/00368

PCT Pub. Date: Jan. 4, 2001

(30) Foreign Application Priority Data

Jun. 25, 1999 (DE) ..... 199 29 183

(51) Int. Cl.[7] ..... B25D 11/00
(52) U.S. Cl. ..... 173/201; 173/109
(58) Field of Search ..... 173/48, 200, 201, 173/212, 109

(56) References Cited

U.S. PATENT DOCUMENTS 3,688,848 A * 9/1972 Vick et al. ..... 173/201
3,835,935 A * 9/1974 Sides et al. ..... 173/14
4,442,906 A * 4/1984 Simpson ..... 173/48
4,567,951 A * 2/1986 Fehrle et al. ..... 173/201
4,602,689 A * 7/1986 Wanner ..... 173/127
5,111,890 A * 5/1992 Ranger et al. ..... 173/104
5,775,440 A * 7/1998 Shinma ..... 173/109
5,873,418 A * 2/1999 Arakawa et al. ..... 173/212
5,975,217 A * 11/1999 Frenzel et al. ..... 173/201
5,992,541 A * 11/1999 Frenzel et al. ..... 173/201

FOREIGN PATENT DOCUMENTS

DE 197 26 272 1/1999
FI 23 35 924 2/1975

* cited by examiner

*Primary Examiner*—Scott A. Smith
*Assistant Examiner*—Chukwurah Nathaniel
(74) *Attorney, Agent, or Firm*—Boyle Fredrickson Newholm Stein & Gratz S.C.

(57) ABSTRACT

The invention relates to a pneumatic percussive mechanism for a percussion drill and/or a drill hammer. The inventive mechanism comprises, housed in the housing of the percussive mechanism, an axially reciprocating percussion piston. A drive piston is axially reciprocated in a guide cylinder of said percussion piston. The guide cylinder is provided on its inner face with one or more air compensation pockets. At least one idle opening extends through the guide cylinder. In the percussive action, the idle opening does not communicate with the ambience while in the idle mode the idle opening can be displaced via an idle channel that leads to the ambience and thus connects a cavity that receives a pneumatic piston with the ambience by way of the idle opening. The air compensation pockets and the idle openings allow and optimization of the piston return behavior and of the idle operation of the percussive mechanism.

14 Claims, 4 Drawing Sheets

PNEUMATIC PISTON PERCUSSIVE MECHANISM WITH A HOLLOW PERCUSSION PISTON

BACKGROUND OF THE INVENTION

1. Field of the Invention

This invention pertains to an air spring impact mechanism for a sledgehammer and/or hammer drill.

2. Description of the Related Art

Of the common types of impact mechanisms in use today for hammer drills or sledgehammers, one design among others has been proven effective in which a drive piston is moved by a crankshaft back and forth inside of a percussion piston, also called a hollow impactor. The percussion piston in turn moves axially inside of an impact mechanism housing, resulting in the formation of an air spring between the drive piston and the percussion piston. This spring conveys the axial motion of the drive piston onto the percussion piston and propels it against a tool shank or an anvil where the momentum of the percussion piston is converted to an impact.

One impact mechanism of this type, for example as seen in DE-OS 22 60 365, has quite a few advantages in comparison to other types. For one thing, the relatively light drive piston produces only minimal vibrations during idling. Furthermore, the impact mechanism is of a simple design, keeping the manufacturing costs low and making it easy to repair. In addition, the impact mechanism has good cold-starting characteristics as it heats up rapidly due to the grease friction between the drive piston and the percussion piston.

However, these types of impact mechanisms are difficult to design with regard to their reverse suction behavior and idle behavior. In particular, if the impact mechanism is designed so that after a successful impact the drive piston always reliably pulls back the percussion piston by suction, the transition to idle mode can be rough when the tool is lifted off of the rock being worked on. In this case, there is the danger that the percussion piston can continue to issue impacts in its idle position. These so-called idle impacts are very unpleasant for the operator and put a large stress on the hammer. On the other hand, if the impact mechanism is designed to provide a reliable transition to idle, the risk arises that the percussion piston is not always being retracted by suction by the drive piston, even during impact operation. This can result in an interruption of impact operation, and thus to irregular functioning.

Another type of impact mechanism is known from DE-OS 22 62 273 in which a percussion piston and a drive piston with the same diameter, both of which move axially, are arranged in a common guide tube. There are idle openings in the guide tube that the percussion piston can pass over when the tool is lifted off of the rock being worked on. This allows the cavity between the percussion piston and the drive piston to communicate with the surroundings, preventing a return suction effect by the drive piston and keeping the percussion piston in its prior position.

From DE 196 21 057 A1, an air spring impact mechanism is known in which the impact by the percussion piston can be dampened by an additional air spring located in front of the percussion piston.

In DE 23 35 924 A1, an air spring impact mechanism is described with an impact mechanism housing, a hollow percussion piston with guide sleeve and a drive piston that moves inside the guide sleeve. Between the drive piston and the percussion piston is a cavity. Also, an air equalization pocket is provided on the inside of the guide sleeve of the percussion piston for the purpose of filling the cavity with air. Idle operation is not possible in the air spring impact mechanism shown. In fact, the drive motor must be shut off to interrupt the work.

OBJECTS AND SUMMARY OF THE INVENTION

The objective of this invention is to provide an air spring impact mechanism with a hollow percussion piston in which the disadvantages described above are avoided without having to forfeit the advantages mentioned.

According to the invention, the objective is met by an air spring impact mechanism as specified in patent claim 1.

In the air spring impact mechanism according to the invention, the inside of a guide sleeve of the percussion piston that forms the cavity thereof is provided with at least one air equalization pocket that extends in the axial direction. Furthermore, at least one idle opening passes through the guide sleeve radially. During impact operation, no connection exists between the idle opening and an idle channel in the impact mechanism housing that leads to the surroundings. This isolates from the surroundings the cavity between the drive piston and the percussion piston constituting the air spring itself On the other hand, during idle operation the idle opening is allowed to pass over the idle channel so that this cavity is connected to the surroundings by means of the idle opening and the idle channel. This enables intensive air equalization during idling, preventing any suction effects caused by the drive piston.

It is preferred for the air equalization pocket to have a larger axial length than a surface of the drive piston in contact with the guide sleeve. This allows air leaking from the air spring with each impact to be refilled from the air equalization pocket.

In an especially advantageous embodiment of the invention, there are a number of idle openings in the guide sleeve that can be arranged in an axially offset fashion. Moreover, the idle openings can have differing cross sectional areas. Depending on the arrangement of the idle openings and on their cross sections, it is possible to design the transition between idle and impact operation to be smooth, which the operator will find particularly comfortable. Also, the tool can be placed at exposed points without the tool jumping inadvertently.

Another embodiment of the invention consists of providing the guide sleeve with numerous glide surfaces upon which it is guided within the impact mechanism housing. Between each of the glide surfaces are notches with smaller radii. As a result of the reduction in frictional surface, and thus reduced friction, between the percussion piston and the impact mechanism housing, better cold-starting behavior can be achieved at low temperatures. Furthermore, the manufacturing costs can be reduced because of the reduction in exterior surface that needs to be machined. The idle openings should be arranged such that they each penetrate a glide surface since this prevents the need for any additional sealing between the guide sleeve of the percussion piston and the impact mechanism housing.

In another advantageous embodiment of the invention, an air cushion is produced in a front cavity between a front side of the percussion piston and the impact mechanism housing. When the front cavity is temporarily isolated from the surroundings as the percussion piston transitions from impact operation to idle operation—in other words when the percussion piston moves forward in the direction of the idle position—air pressure can build up in this cavity so that some of the kinetic energy of the percussion piston is conveyed to the air spring arising in the cavity.

In another advantageous embodiment of the invention, when the percussion piston has reached its final idle position, the front cavity can be brought to connect to the surroundings through one of the notches. This allows the air compressed in the front cavity to leak out, releasing the energy stored in the air spring by pressure relief.

The result, then, is that the air spring also functions as an air cushion, decreasing the kinetic energy of the percussion piston so that it is braked before it hits an end wall of the housing and thus reaches its idle position. The percussion piston is thus prevented from impacting the housing too heavily, which is also a comfort to the operator.

BRIEF DESCRIPTION OF THE DRAWING

This and other features and advantages of the invention are explained below in more detail with the help of the accompanying figures. Shown are.

Figure 1:
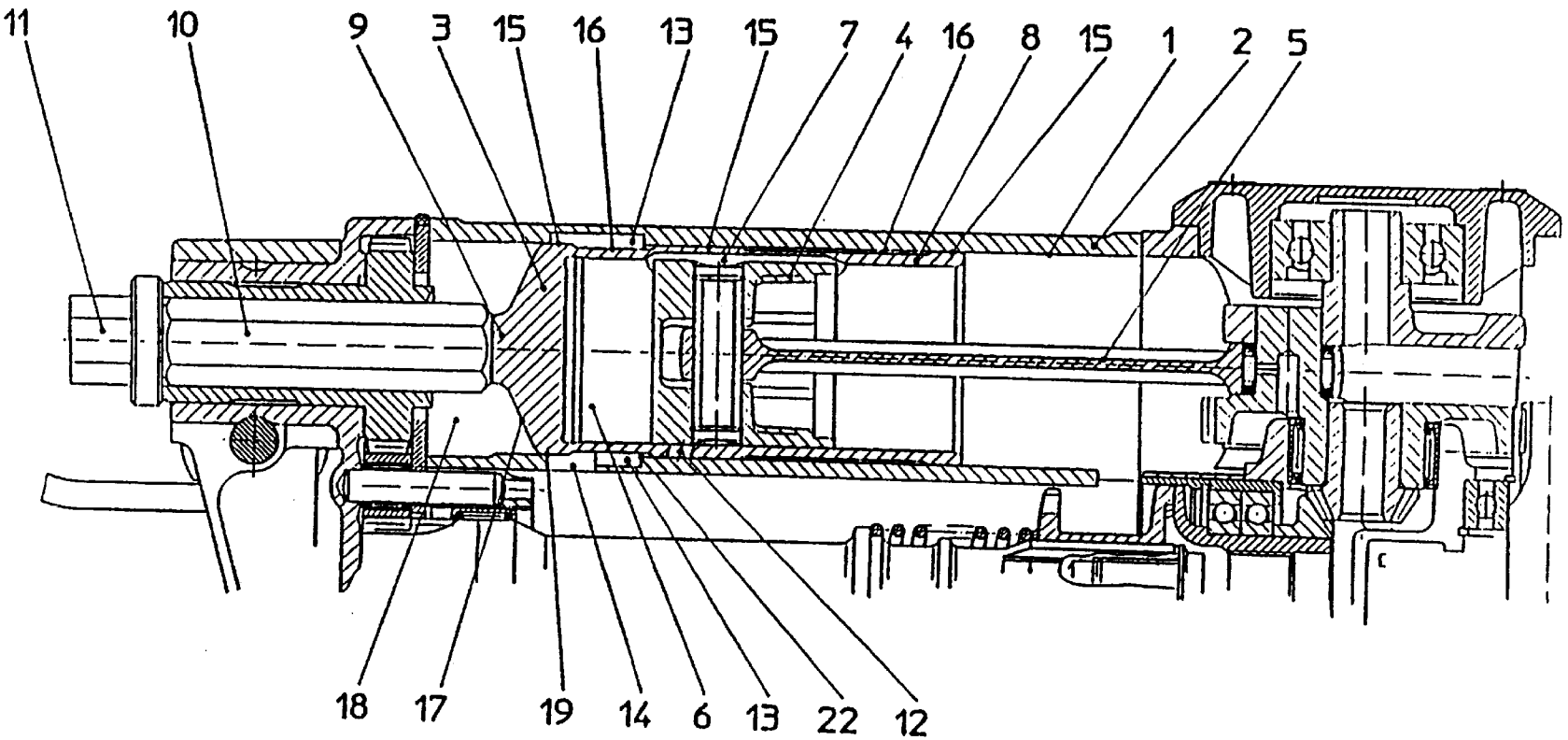
FIG. 1 a section through an air spring impact mechanism according to the invention in the impact position.

Since all figures in principle show the same air spring impact mechanism, but in different operating positions only, the same references will be used.

DETAILED DESCRIPTION OF THE PREFERRED EMBODIMENTS

A percussion piston 3 moves axially along a guide surface 1 of an impact mechanism housing 2. A drive piston 4 is moved inside the percussion piston 3 from one hollow end. This drive piston is driven back and forth in a known fashion using a connecting rod 5.

A cavity 6 that constitutes an air spring is formed between the percussion piston 3 and the drive piston 4.

The percussion piston 3 has at least one, but as needed two, three or more air equalization pockets 7 that run axially along the interior surface of a guide sleeve 8 of the percussion piston 3 that forms the cavity thereof. These air equalization pockets are longer than the axial length of a surface of the drive piston 4 in contact with the percussion piston 3. The air equalization pockets 7 are distributed evenly along the perimeter of the guide sleeve 8. The percussion piston 3 consists essentially of the guide sleeve 8, a piston head and a piston extension 9 extending from the piston head.

A shank 10 of a tool 11 is located in front of the piston extension 9 in such a way that the piston extension 9 of the percussion piston 3 can impact the shank 10 (FIG. 1).

Figure 3:
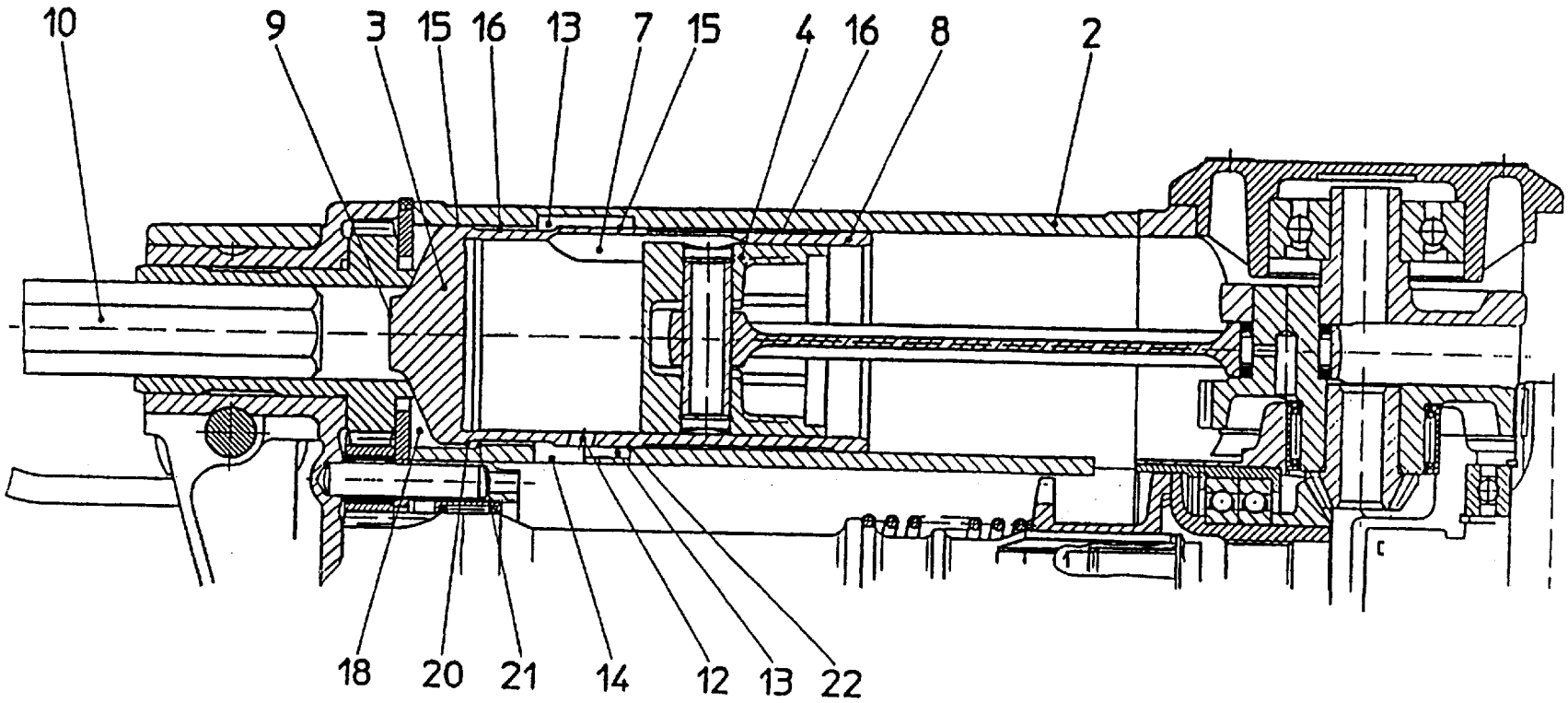
FIG. 3 a section through the air spring impact mechanism in the idle position.
Figure 4:
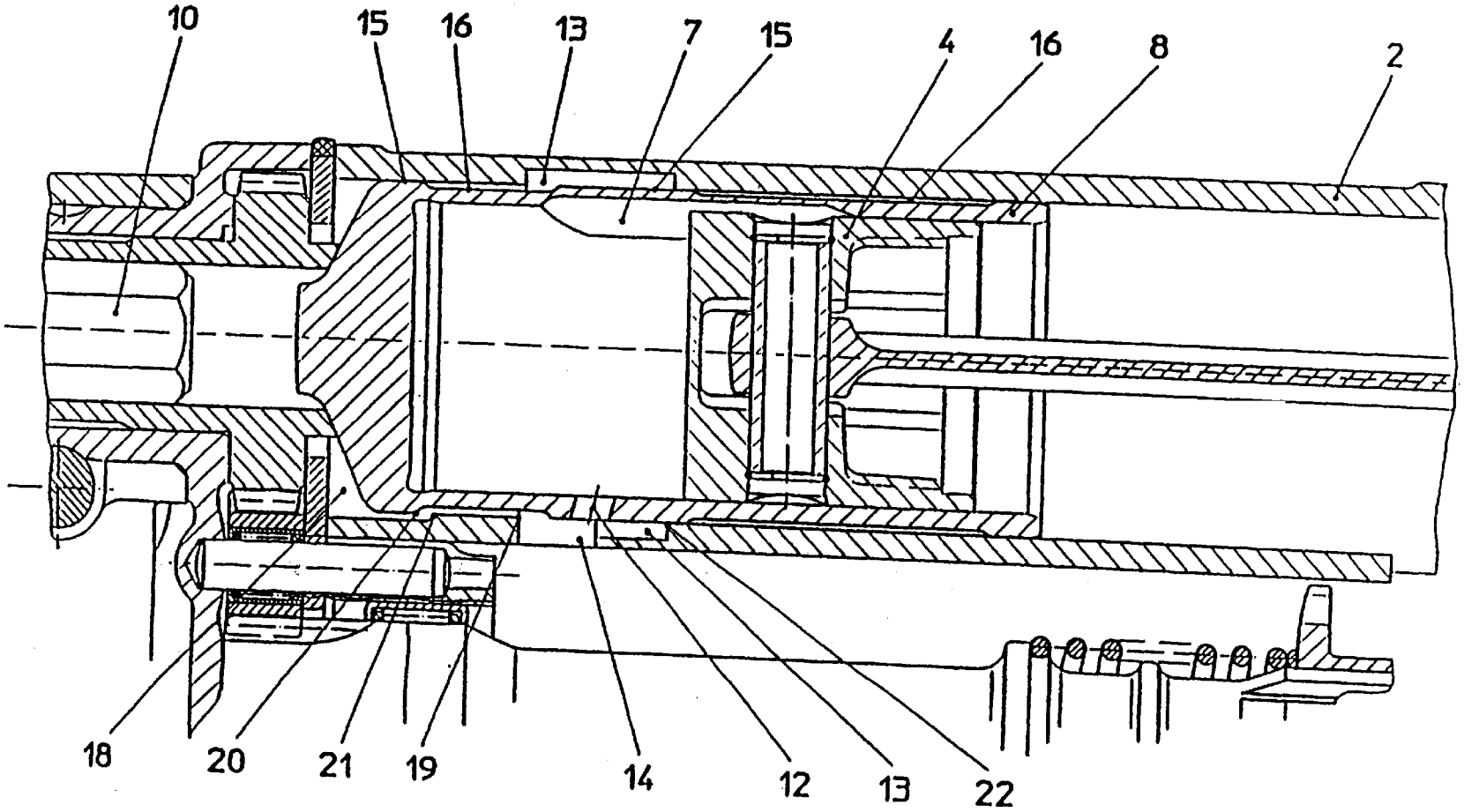
FIG. 4 an enlarged excerpt from FIG. 3.

Also, there are at least one, but preferably two, three or more idle openings 12 in the guide sleeve 8 that penetrate the guide sleeve 8 radially. These openings allow the cavity 6 to be connected to an idle channel 13 (FIGS. 3 and 4).

The idle openings 12 are distributed as evenly as possible on the perimeter of the guide sleeve 8 for reasons of symmetry, but at positions different from the air equalization pockets 7. Symmetry of the guide sleeve 8 as well as of the percussion piston 3 should be strived for mainly for manufacturing reasons so as to prevent distortion of the percussion piston 3, for example due to grinding. In another embodiment form of the invention, which is not shown, the idle openings 12 are however also located at the same positions as the air equalization pockets 7, in other words they penetrate out through the rear wall of the air equalization pockets 7, which are thinner than the thickness of the guide sleeve 8.

The axes of the idle opening 12 holes can be perpendicular to the axis of impact, i.e. perpendicular to the direction of motion of the percussion piston 3. However, it is especially advantageous if the hole axes are at an angle with respect to the impact axis and if the idle openings 12 in the guide housing 8 are directed forward and to the outside. This will allow grease that had gathered during a previous stroke at the idle opening 12 to be thrown out from the idle opening 12 when the percussion piston 3 hits the shank 10. Otherwise, i.e. if the hole axis of the idle openings 12 and the axis of impact are perpendicular to one another, the problem can occur that the holes are at least partially stopped with grease, which could reduce the reliability when transitioning to idle operation.

The idle channel 13 is connected to the surroundings through connection channel 14. The surroundings can, for example, be the crankcase of the crankshaft drive for the drive shaft 4. The idle channel 13 is designed as an annular channel in the embodiment form shown. Of course, the idle channel 13 and the connection channel 14 can also have other forms. For example, they can consist of merely a sufficiently liberal recessed area. It is important here that the cavity 6 be able to be connected to the surroundings in a suitable fashion so as to attain the desired pressure equalization.

An exterior surface of the percussion piston 3 which is guided within the guide surface 1 of the impact mechanism housing 2 is formed by a number of glide surfaces 15—three in this case. Notches 16 are made between adjacent glide surfaces 15.

Because only a portion of the exterior surface of the percussion piston 3 has to be machined as a glide surface 15, manufacturing costs can be saved. Furthermore, due to the smaller surface friction between the percussion piston 3 and the impact mechanism housing 2, improved cold-start behavior is achieved.

Figure 2:
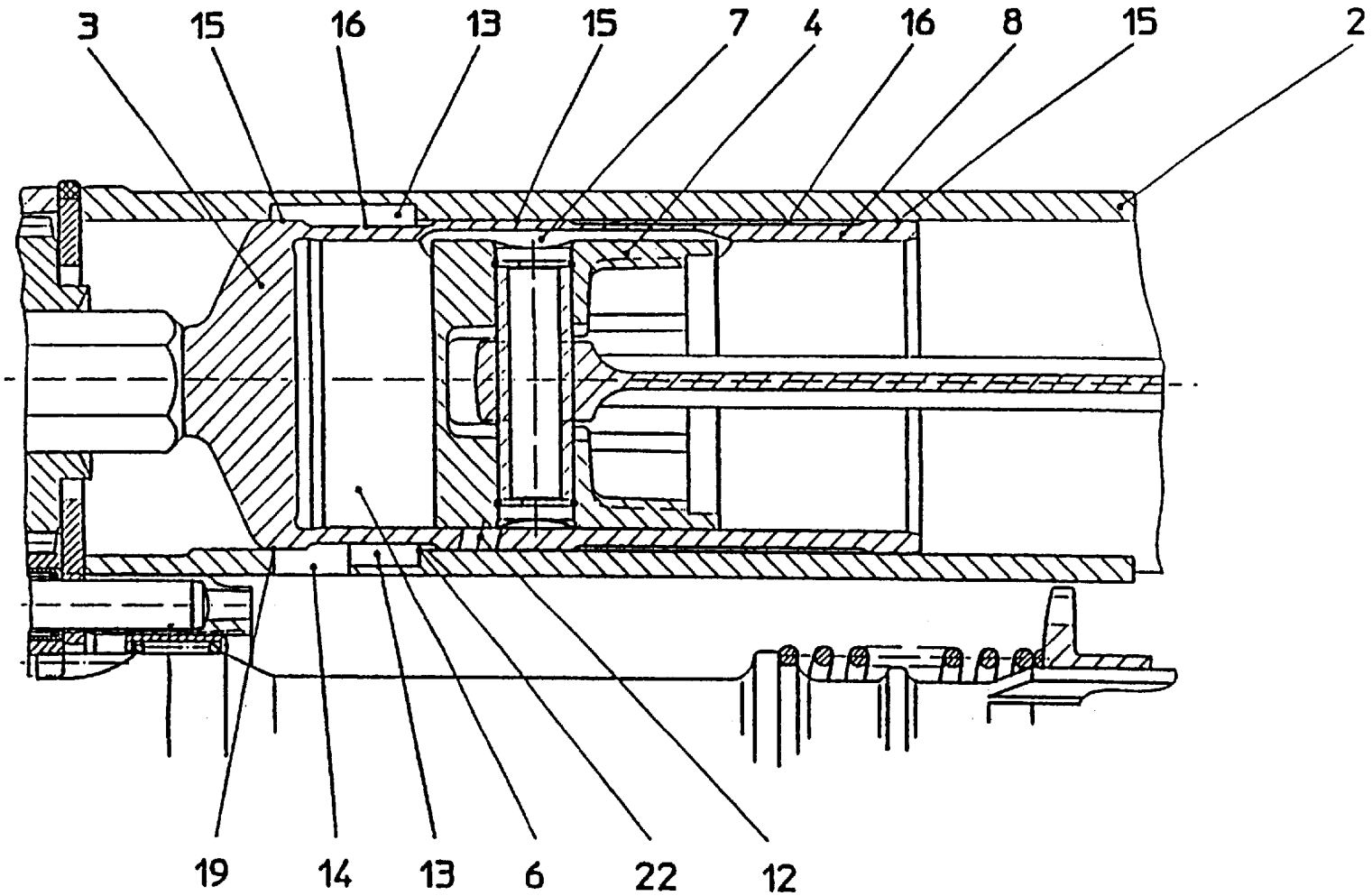
FIG. 2 an enlarged excerpt from FIG. 1.

A front air spring is created in a cavity 18 between a front side 17 of the percussion piston 3 and the impact mechanism housing 2 if the front glide surface 15 interrupts a connection to the idle channel 13 as shown in FIGS. 1 and 2. In the impact position shown in FIGS. 1 and 2, the percussion piston 3 cannot move further forward (to the left in the figures). This means that the air pressure in cavity 18 corresponds essentially to the surrounding air pressure, since in the position shown the percussion piston 3 just then passes over a control edge 19 at the impact mechanism housing 2. However, the front glide surface 15 and the guide surface 1 of the impact mechanism housing seal off the front cavity 18 from the surroundings. If the tool 11 is now pulled away from the rock being worked on and the shank 10 of the tool then moves out forward from the impact mechanism housing 2 by a specific length, the percussion piston 3 can also move forward again in the next impact cycle. This makes the cavity 18 smaller and compresses the air in the air spring. In this way the percussion piston is braked.

When the percussion piston 3 has reached its final idle position shown in FIGS. 3 and 4, a control edge 20 designed at the front end of the front notch 16 on the percussion piston 3 has also passed over a control edge 21 at the impact mechanism housing 2. This connects the cavity 18 to the surroundings through notch 16 and idle channel 13, allowing the compressed air to leak from the air spring in cavity 18. This means that the energy stored in the air spring and resulting from the forward motion of the percussion piston 3 is dissipated to the surroundings. The impact of the percussion piston 3 against the impact mechanism housing 2 is thus considerably dampened when the idle position is reached. Thus, the air spring produced in the cavity 18 can also function as an air cushion. Since the air in cavity 18 returns to surrounding air pressure in its idle position, the percussion piston 3 is not pushed back from its idle position. This is only possible by first re-positioning the tool 11 onto the rock, which results in shank 10 moving the percussion piston 3 to the impact position.

The function of the air spring impact mechanism is explained below:

In the impact position shown in FIGS. 1 and 2, the drive piston 4 regularly passes over the air equalization pockets 7, producing a short-term connection each time between the cavity 6 and the surroundings, which is the crankcase. This allows for compensation of the air loss in the air spring in cavity 6 after each impact cycle.

When the tool 11 is removed from the rock that is being worked on, the tool shank 10 slides somewhat out of the hammer housing so that the impact piston 3 can assume the idle position shown in FIGS. 3 and 4. In the process, at least one of the idle openings 12 passes over a rear edge of the idle channel 13 serving as a control edge 22, resulting in a communicating connection between the cavity 6 and the surroundings through the idle opening 12, the idle channel 13 and the connection channel 14. In this way, any backward suction effects of the air spring in the cavity 6 are prevented so that the impact mechanism can reliably transition to idle mode without the danger of idle impacts.

As already described, it is advantageous to provide a number of idle openings 12 in the guide sleeve 8 so that the transition between idle and impact operation can proceed smoothly and not suddenly. This is particularly the case if the idle openings 12 pass over the control edge 22 at different times and with different cross sections.

The effects of the air spring or air cushion described above come into play in the front cavity 18 as well.

The ability, created by the invention, of carrying out the functions of "air equalization" and "idle" by different components—here: air equalization pockets 7 and idle openings 12—makes it possible to optimize both functions independently of one another and to adjust them according to requirements. Using large air cross sections in a number of air equalization pockets 7, an intensive air equalization with the air spring in cavity 6 can be done, eliminating the tendency of collision in the impact mechanism, i.e. the tendency of the drive piston 4 to hit the percussion piston 3, while at the same time not affecting the important backward suction of the percussion piston 3 where there is no recoil.

The axial arrangement of the idle openings 12 that is important for proper idling can be varied within wide limits without having to modify the air equalization pockets 7.

The symmetry of the percussion piston 3 allows practically no distortion during its manufacture, which lowers manufacturing costs and increases its fatigue strength.

We claim:

1. An air spring impact mechanism for a sledgehammer and/or hammer drill comprising:

an impact mechanism housing;

a percussion piston that moves axially back and forth and is hollow at one end and has a guide sleeve that slides within the impact mechanism housing;

a drive piston that moves inside of the guide sleeve of the percussion piston axially back and forth;

a cavity located between the drive piston and the percussion piston that forms an air spring;

wherein at least one air equalization pocket extends axially along the inside of the guide sleeve of the percussion piston;

wherein the guide sleeve of the percussion piston has at least one idle opening penetration;

an idle channel is designed into the impact mechanism housing that communicates with the surroundings;

no connection between the idle opening and the idle channel occurs during impact operation of the air spring impact mechanism, and that;

during idle operation, the idle opening can be moved over the idle channel and the cavity can be put in connection with the surroundings through the idle opening and the idle channel.

2. An air spring impact mechanism according to claim 1, wherein the air equalization pocket is longer axially than a surface of the drive piston in contact with the guide sleeve.

3. An air spring impact mechanism according to claim 1, wherein three air equalization pockets and three idle openings are provided each in the guide sleeve evenly distributed about the perimeter.

4. An air spring impact mechanism according to claim 1, wherein a number of idle openings are provided in the guide sleeve at different axial positions with respect to the main axis of the guide sleeve.

5. An air spring impact mechanism according to claim 1, wherein a number of idle openings exist with different cross sectional open areas.

6. An air spring according to claim 1, wherein a number of glide surfaces are provided in an exterior perimeter surface of the guide sleeve by means of which the guide sleeve is guided within the impact mechanism housing.

7. An air spring impact mechanism according to claim 6, wherein notches with a smaller radius are provided between neighboring glide surfaces.

8. An air spring impact mechanism according to claim 6, wherein one of the glide surfaces has an idle opening penetration in it.

9. An air spring impact mechanism according to claim 1, wherein the idle channel is an annular design in a guide surface of the impact mechanism housing that guides the percussion piston.

10. An air spring impact mechanism according to claim 9, wherein the idle channel communicates with the surroundings through a connection channel.

11. An air spring impact mechanism according to claim 1, wherein an air cushion can be produced in a cavity designed between a front side of the percussion piston and the impact mechanism housing.

12. An air spring impact mechanism according to claim 11, wherein the front cavity is isolated from the surroundings temporarily during the transition of the percussion piston from impact operation to idle operation.

13. An air spring impact mechanism according to claim 11, wherein the front cavity is connected to the surroundings during idle operation.

14. An air spring impact mechanism according to claim 1, wherein the air equalization pocket and the idle opening are located at different positions on the guide sleeve.

* * * * *